United States Patent [19]

Crosby

[11] Patent Number: 4,846,450

[45] Date of Patent: Jul. 11, 1989

[54] FURNITURE WEDGE SEAT ASSEMBLY

[75] Inventor: Lawton H. Crosby, Lake Bluff, Ill.

[73] Assignee: Morley Furniture Spring Corporation, Lake Bluff, Ill.

[21] Appl. No.: 139,264

[22] Filed: Dec. 29, 1987

Related U.S. Application Data

[63] Continuation-in-part of Ser. No. 848,787, Apr. 7, 1986, Pat. No. 4,715,587.

[51] Int. Cl.[4] ..... A47C 23/12

[52] U.S. Cl. ..... 267/112; 267/103

[58] Field of Search ..... 5/200 B, 247, 255; 267/103, 110, 111, 112

[56] References Cited

U.S. PATENT DOCUMENTS

| | | | |
|---|---|---|---|
| 340,029 | 4/1886 | Burkhardt | 267/110 |
| 2,514,182 | 7/1950 | Flint | 267/110 |
| 2,785,738 | 3/1957 | Kendall | 267/110 |
| 3,112,924 | 12/1963 | Reed | 267/103 |
| 3,610,607 | 10/1971 | Pofferi | 267/110 X |

FOREIGN PATENT DOCUMENTS

| | | | |
|---|---|---|---|
| 26245 | of 1907 | United Kingdom | 267/110 |

*Primary Examiner*—Duane A. Reger

*Attorney, Agent, or Firm*—Willian, Brinks, Olds, Hofer, Gilson & Lione

[57] ABSTRACT

A furniture wedge seat comprising a wedge shaped frame including a relatively short front rail, a relatively long back spring rail, and converging (back-to-front) side rails. A spring assembly including primary load bearing spring elements is mounted in the frame with these primary elements disposed parallel to each other. Bracketing the primary spring elements are secondary cushion bearing spring elements. The primary and secondary elements are interconnected by tie wires.

16 Claims, 3 Drawing Sheets

FURNITURE WEDGE SEAT ASSEMBLY

RELATED APPLICATION

This application is a continuation-in-part of copending U.S. patent application Ser. No. 06/848,787, filed Apr. 7, 1986, issued on Dec. 29, 1987, as U.S. Pat. No. 4,715,587.

FIELD OF THE INVENTION

This invention relates in general to furniture seats. It relates particularly to furniture seats of the type which are commonly referred to as "wedges".

BACKGROUND OF THE INVENTION

All "wedges" are now fan sprung. In other words the spring elements, whether they be sinuous bands, Pirelli webbing, or any other resilient support elements, are arranged in a fan-like pattern extending between the short, straight, front rail of a wedge frame and the long, arcuate, back rail of the frame (or a plurality of supplementary rail members subtending chords of the arc across its length). In this regard, conventional straight, front rail length is on the order of sixteen to eighteen inches while arcuate, back rail length is on the order of four or more times the front rail length.

Where sinuous springs are employed, for example, as many as nine individual spring bands are employed, and invariably fan sprung. At their converging ends, the connections to the front rail are very close together, often touching. The strain exerted on the front rail by these closely grouped springs is very substantial; so great as to occasionally cause rail splitting. As such, the frame must be very sturdily constructed and, as a result, it costs more to make than conventional frames. Furthermore, the quality of the seat at the front rail is very poor, i.e., it is so stiff as to give the seating quality of a springless cushion support system. In contrast, the seat quality at the back rail is soft as to be mushy and lack support, since fan-sprung diverging springs are as far as ten inches apart there.

In essence, the furniture industry expects conventional "wedges" to sit terribly. Their lack of comfort is accepted in the interest of design requirements in corner groupings of cushioned furniture.

SUMMARY OF THE INVENTION

An object of the present invention is to provide a new and improved furniture wedge seat assembly.

Another object is to provide a furniture wedge seat assembly which produces more uniform cushion support than conventional furniture wedges.

Yet another object is to provide a furniture wedge seat assembly which produces less frame strain than conventional furniture wedges.

Still another object is to provide a furniture wedge seat assembly which affords a uniformly soft, yet firm, seat from front to back and from left to right.

The foregoing and other objects are realized in accord with the present invention by providing a furniture wedge seat assembly for a cushioned furniture wedge wherein resilient support elements are mounted parallel to each other. The elements include a plurality of primary elements mounted between the short front rail of the wedge frame and a back spring rail extending parallel to the front rail. The elements also include at least one secondary element mounted between each of two converging side rails and the back spring rail.

A furniture wedge seat assembly embodying features of the invention may take several forms. Four forms of the invention are disclosed here. Each is disclosed in the context of a spring assembly comprising sinuous spring bands. However, the invention contemplates the use of resilient cushion support members in other forms.

In a first form of the present invention a wedge frame is formed of a short, straight front rail, a long, arcuate back rail, and a pair of long side rails rigidly connecting the two and converging from back to front. A straight back spring rail extending parallel to the front rail is mounted between the back corners of the frame, i.e., where the back rail and side rails meet and are joined. All of the rails are vertical which means, in the furniture art, that their long dimension or width is disposed vertically.

A spring assembly comprises four primary or load support spring band assemblies and two secondary or cushion support spring band assemblies. The four primary spring band assemblies each include a sinuous spring band having torsion inducing bends formed unitarily therewith.

The two secondary spring band assemblies each comprise a plain sinuous spring band without bends. Normally, the secondary spring bands are also fabricated of lighter gauge spring steel than the primary spring bands. Primary spring bands are normally 8 or 8½ gauge, while secondary spring bands are normally 9 to 11 gauge.

The four primary spring band assemblies and two secondary spring band assemblies are tied together transversely of the frame by two tie wires. These two tie wires, one adjacent the back spring rail and one about one-third of the distance toward the front rail from the back spring rail, are clamped to each spring band and may be fastened to corresponding side rails.

A third, forwardmost tie wire is disposed two-thirds of the distance toward the front rail from the back spring rail. The third tie wire is clamped only to the primary bands, i.e., it is forward of the secondary bands and it is not fastened to the side rails.

In a second form of the invention the wedge frame is identical to that embodied in the first form of wedge seat assembly but the spring assembly is different. Instead of four primary spring band assemblies this form of the invention employs five or six primary spring band assemblies. These five or six primary spring band assemblies comprise ordinary sinuous spring bands, i.e., without torsion bends. Furthermore, the bands are connected directly to clips on corresponding rails, rather than through articulate links. The bands and rails are tied together in a manner identical to that of the first form of the invention.

In third and fourth forms of the invention the back rail construction is modified. The spring assemblies are similar to those of the first and second forms.

The third form employs a single, arcuate back rail fabricated of hardwood about one inch thick and three to four inches wide, i.e., the back rail is disposed horizontally. Pairs of holes are bored vertically through the thickness of this rail, one pair for each spring band to be connected to the rail. The holes are in alignment with each other and that alignment is parallel to the front rail.

A generally U-shaped anchor link is threaded up or down through each pair of holes so that its connector clips protrude through the rail and face away from the front rail. The back end linear segment of each sinuous spring band is seated in the hooks of a single link and connected to the back rail in this manner.

The fourth form employs a different kind of back rail construction. The back spring rail is not mounted directly between the back corners of the frame, as in the first and second forms of the invention. The back spring rail here is fastened to two back-up rail, sections which, themselves, are fastened to the inside of the back frame rail and define chords of the arc of that rail.

The net result of this invention is a wedge seat which is vastly more superior in seat quality, both from front to back and from left to right. In fact, the seat quality compares very favorably with adjacent pieces in modular sectional groups such as armless chairs, one-arm loveseats, sofas, etc. The wedge seats provide equal sitting performance from the left side to the right side of the wedge itself. The wedge of the present invention produces a major reduction in frame strain, and a major reduction in labor and material costs. It is also adaptable to various spring support techniques.

Regardless of which form of the invention is utilized, the secondary spring bands, sometimes referred to here as "outrigger" bands, are connected to corresponding side rails by connector clips which are mounted for pivotal movement about a vertical axis. As such, the clips are free to pivot into alignment with corresponding "outrigger" bands when they are connected.

BRIEF DESCRIPTION OF THE DRAWINGS

The invention, including the construction and operation of the various. embodiments, is illustrated more or less diagrammatically in the drawings, in which.

DESCRIPTION OF THE PREFERRED EMBODIMENTS

Figure 1:
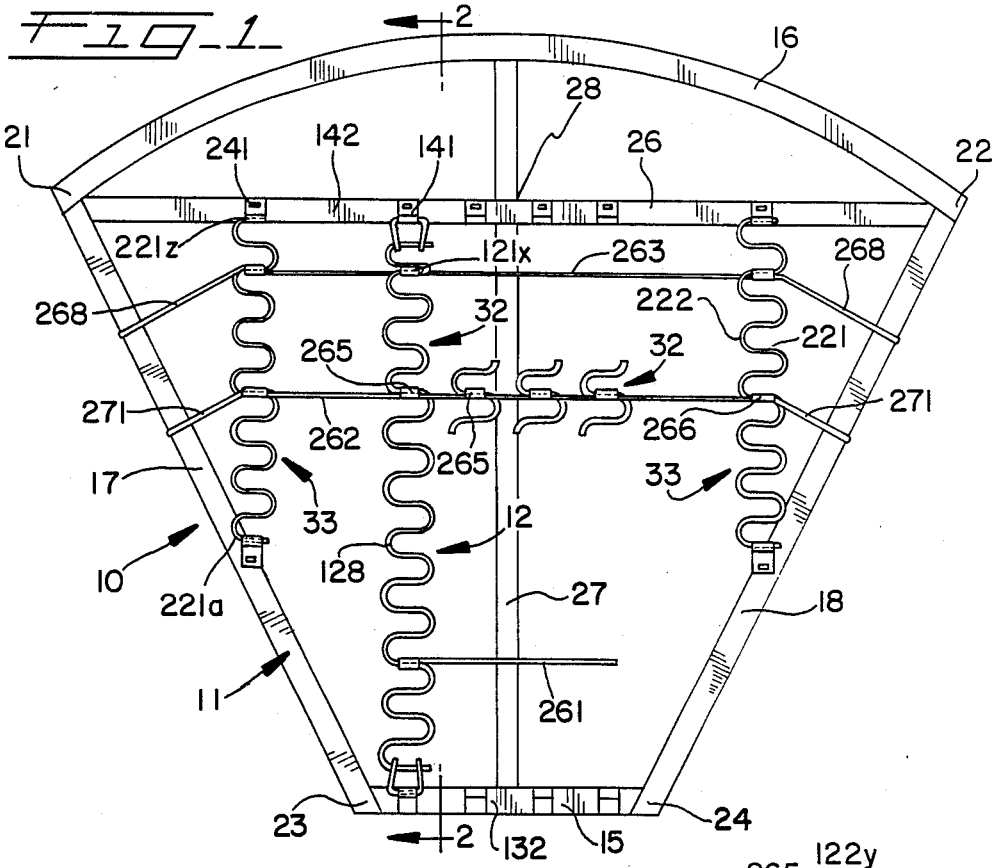
FIG. 1 is a plan view of a furniture wedge seat assembly embodying features of a first form of the invention.
Figure 2:
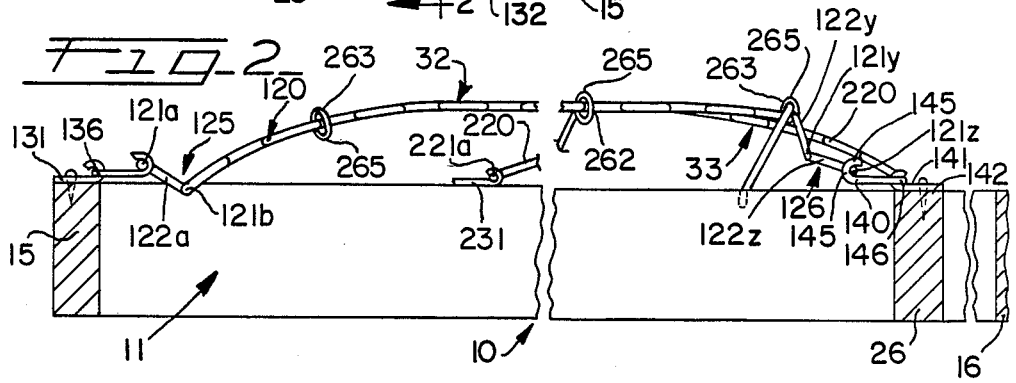
FIG. 2 is a sectional view taken along line 2—2 of FIG. 1.
Figure 3:
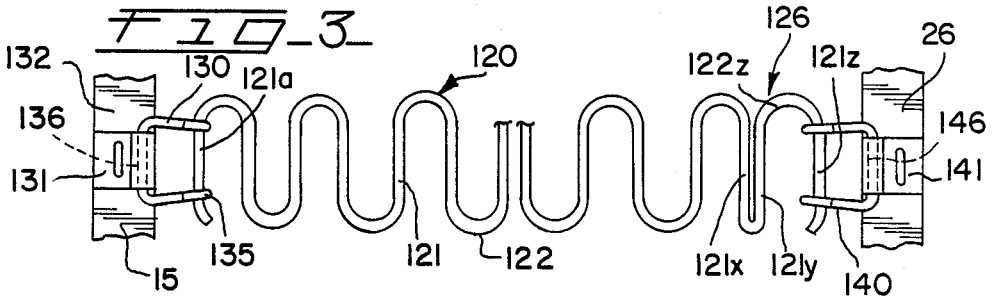
FIG. 3 is an enlarged plan view of one of the support spring assemblies in the seat assembly of FIGS. 1 and 2.

Referring to the drawings, and particularly to FIGS. 1–3, a wedge seat assembly embodying features of a first form of the present invention is illustrated generally at 10. The assembly 10 includes a wedge frame 11 in which is mounted a spring assembly 12, the latter adapted to be covered by upholstery fabric and to support a suitably shaped cushion (not shown).

The frame 11 includes an approximately eighteen inch, straight, front rail 15, and an arcuate back rail 16 which is normally from fifty-four to eighty inches long. Two converging side rails 17 and 18 interconnect the front and back rails 15 and 16, as illustrated. The side rails 17 and 18 are of lengths to suit the style desired; here they are fifty-four inches long.

Each of the rails 15–18 is cut from hard wood, the front rail 15 to a thickness of one inch and the side rails 17, 18, and back rail 16, to a thickness of seven-eighths of an inch. Each rail is three inches wide, standing on edge.

At their joined ends, corners 21 and 22 in back and corners 23 and 24 in front, the rails 15–18 are glued and screwed together in a well known manner. Between the back corners 21 and 22, parallel to the front rail 15, a back spring rail 26 is provided. The back spring rail 26 is cut from hardwood and is the same thickness and width as the front rail 15. The rail 26 is glued, screwed, or doweled between the ends of the back rail 16, and corresponding side rails 17 and 18, at the back corners 21 and 22.

A stretcher rail 27 is mounted between the front rail 15 and the back rail 16. The rail 27 is notched at 28 (along with the back spring rail 26) where it crosses the back spring rail so as to rigidly interconnect the two. The rail 27 is the same material, thickness, and width as the rail 15.

The spring assembly 12 includes four primary spring band assemblies 32 mounted between the front rail 15 and the back spring rail 26. The spring assembly 12 also includes two secondary or "outrigger" spring band assemblies 33 mounted between the back spring rail 26 and each of the side rails 17 and 18.

The spring band assemblies 32 are identical to those illustrated in FIGS. 1 and 2 of the aforementioned copending application. Each spring band assembly 32 comprises a normally arced, "regular" or "X-L" loop, sinuous spring band 120. Each band 120 comprises a series of normally parallel linear wire segments 121 interconnected by a series of generally semi-circular wire segments 122. In "regular" loop sinuous, the linear wire segments 121 are spaced at seven-eighth's of an inch intervals. "X-L" loop sinuous, delinear wire segments are spaced one and one-eighth inches apart. The bands 120 are fabricated from eight gauge spring steel wire in a known manner.

A front bend complex 125 is formed in the front end of the band 120 and a back bend complex 126 is formed in the back end of the band. Each bend complex 125 comprises one or more linear wire segments 121 and semi-circular wire segments 122 bent out of the normal arc of the band 20. The unbent body 128 of the band 120 extends between the bend complexes 125 and 126.

The front bend complex 125 comprises the forwardmost linear segment **121*a* in the band 120 and the adjacent, forwardmost, semi-circular segment 122*a*, bent outwardly in a plane about an axis defined by the penultimate linear segment 121*b* at the front end of the band 120. The plane defined by these segments 121*a*, 122*a*, and 121*b* is, after the bending operation, disposed at an interior angle of 130° to the arc of the body 128 of the band 120 or, more precisely, to a tangent to that arc. The segments 121*a*, 122*a*, and 121*b* form an upwardly and forwardly inclined leg which joins the body 128 of the band 120 at its lower end segment 121*b***.

The back bend complex 126 comprises the two rearwardmost linear segments **121*z* and 121*y*** in the band 120, with the adjacent two semi-circular segments 122z and 122y, bent inwardly about an axis defined by the linear segment 121x, which is the third linear segment from the back end of the band. The plane formed by the segments 121x, 122y, and 121y is disposed at an interior angle of 110° to the body 28 of the band 20.

As will be seen there are actually two bends in the back bend complex 126. The first, or inner bend, which has been described, is about the linear segment 121x. The second, or outer bend, is about the linear segment 121y. As a result of the second bend, a plane formed by the segments 121z, 122z, and 121y, defines an interior angle of 120° with the plane of the segments 121x, 122y, and 121y. The segments 121z, 122z, and 121y therefore extend approximately parallel to the tangent to the body 128 of the band 120. The segments 121x, 122y, and 121y define an inner leg having an upper end 121x and a lower end 121y.

Each band 120 is mounted between the front rail 15 and the back spring rail 16 of the frame 11 by being stretched out (from a relaxed, generally circular configuration) and pivotally connected to corresponding rails at its forwardmost linear wire segment 121a and at its rearwardmost linear wire segment 121z. An anchor link 130 connects the wire segment 121a to a conventional EK clip 131 stapled to the top surface 132 of the rail 15. Another anchor link 140 connects the wire segment 121z to an EK clip 141 stapled to the top surface 142 of the rail 26.

The anchor links 130 and 140 are preferably constructed in the manner illustrated in FIG. 1 of Crosby U.S. Pat. No. 3,790,149. The end clip 135 of each anchor 130 pivotally seats on a linear wire segment 121a while its base leg 136 is pivotally seated in an EK clip 131. In turn, the end clip 145 of each anchor 140 pivotally seats on a linear wire segment 121z while its base leg 146 is pivotally seated in an EK clip 141.

With the band 120 mounted in this way the back end of the body 128 of the band, at the linear segment 121x, is disposed above the top surface 142 of the rail 16 by a distance approximately equal to the distance between the linear segments 121x and 121y. At the same time, the front end of the body 128 of the band 120, at the linear segment 121b, is disposed below the top surface 132 of the front rail 15 by a distance approximately equal to one-half the distance between the linear segments 121a and 121b.

With the spring band assemblies 32 at rest, i.e., with no one seated on the furniture seat 10 in which it is incorporated, the rear end bend complexes 126 are effective to create a forward trending compression in the body 128 of each band 120. This is achieved through a torque effect created by the tendency of the vertical inner leg in the bend complex 126 to rotate in a counterclockwise (CCW) direction when it is under load. The effect is to compress the body 128 of the band 120 slightly in the direction of the front rail 15, for approximately two-thirds the distance from the rail 16 to the front rail, and force the linear segments 121 of the stretched band 120 back into parallel relationship.

At the same time, the front end bend complex 125 in each band assembly 32 is effective to create a rearward trending compression in the body 128 of the band 120. This is achieved through a torque effect created by the tendency of the inclined bend complex 125 to rotate in a counterclockwise (CCW) direction also, albeit from the bottom inward rather than, as with the front back complex, from the top forward. Rearward compression force induced by the bend complex 125 is only about one-half the forward compression force exerted in the band 120 by the bend complex 126. As a result, these opposite trending forces equalize at a point about one-third of the way back from the front rail 15 to the rail 16. Nevertheless, the torque effect of the bend complex 125 tends to compress the band rearward in the body of the band 120 to this point and urge the linear segments 121 in that section of the band into parallel relationship.

The two "outrigger" spring band assemblies 33 can be and are, as illustrated here, substantially less sophisticated than the band assemblies 32 and, as a result, are considerably lower in cost to the manufacturer. Each band assembly 33 comprises a normally arced, "regular" loop, sinuous spring band 220. The band 220 comprises a series of normally parallel linear wire segments 221 interconnected by a series of generally semi-circular wire segments 222. The linear wire segments 121 are spaced at seven-eighth's of an inch intervals. The band 220 is fabricated of lightweight, nine and one-half to eleven gauge spring steel wire.

Each band 220 is mounted between a side rail 17 (or 18) and the back spring rail 26 of the frame 11 by being stretched out (from a relaxed, generally circular configuration) and pivotally connected to corresponding rails at its forwardmost linear wire segment 221a and at its rearwardmost linear wire segment 221z. The wire segment 221a is seated in a conventional EK clip 231 pivotally secured to the top surface 232 of the corresponding side rail 17, or 18, just forward of its midpoint. The wire segment 221z is seated in an EK clip 241 stapled to the top surface 242 of the rail 26.

Figure 4:
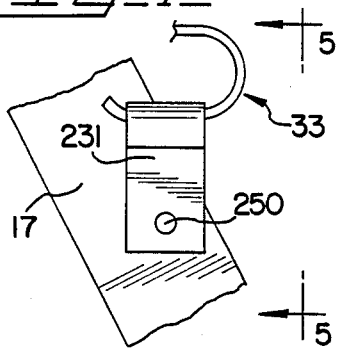
FIG. 4 is a further enlarged plan view of the rail connection between an "outrigger" cushion support spring band in the seat assembly and a corresponding side rail.
Figure 5:
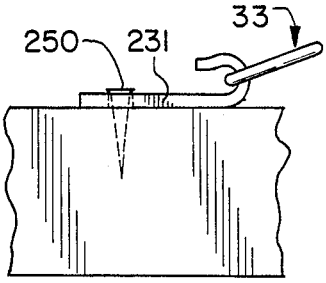
FIG. 5 is a view taken along line 5—5 of FIG. 4.

As seen in FIGS. 4 and 5 the clips 231 are pivotally secured to side rails 17 and 18 by single attachment nails 250. The clips 231 are, accordingly, free to pivot into alignment with corresponding bands 33. Off-center loading, with concomitant distortion of the clips 231, is avoided.

Referring again to FIGS. 1 and 2, the spring assembly 12 also includes three tie wires 261, 262, and 263. Each wire 261, 262 and 263 comprises a single strand of twelve gauge, paper covered wire, and each is clamped to all four spring bands 120 by identical barrel clamps 265.

The rearwardmost tie wire 261 is clamped to each of the bands 120 at the linear segment 121x. It extends straight outwardly and is clamped to each outrigger band 220 by a barrel clamp 266. The opposite ends 268 of the wire 261 are then bent forwardly and downwardly to overlie the corresponding side rail 17, or 18, where they are stapled to the outside of those rails.

The intermediate tie wire 262 is clamped and fastened in a manner identical to the tie wire 261. However, it is positioned forward of the wire 261, as illustrated in FIG. 1, to a point one-third of the distance between the back spring rail 16 and the front rail 15. The opposite ends 271 of the wire 262 are stapled to side rails 17 or 18.

The front tie wire 263 is clamped and fastened only to the bands 120, as illustrated. It is positioned at a point two-thirds of the distance between the rail 16 and the front rail 15. The tie wire 263 terminates at the outermost primary spring band assemblies 32, in clamps 265.

With the spring assembly 12 assembled in the frame 11 in this manner, it is covered with upholstery fabric to form a base for a cushion (not shown). The fabric (also not shown) fastens over the front rail 15, the side rails 17 and 18, and the arcuate back rail 16.

When someone sits on the seat assembly 10, or rather the upholstery and padding which covers the spring assembly 12, it is normal for the subject's buttocks to come to rest and press down first in the center of the back two-thirds of the bands 120. Initially, this causes the rear end of these bands to move downwardly without much deflection because the anchor links 140 pivot about their connections with the rail 16 at the linear band segments 21z. An "initial softness" in the feel of the seat is the result.

As the anchor links 140 pivot downwardly, the lower end of each bend complex 126 is pulled outwardly, increasing the torque effect of the inner leg in the complex, and creating greater forward trending compression in the body 128 of the band 120. This increases the resilience of the band in its back two-thirds and creates substantial uplifting force under the subject's buttocks.

Meanwhile, the thighs of the subject are engaging and forcing the forward one-third of the band 120 downwardly. Initial softness is again created, this time by the pivoting of the swing anchor 130 downwardly.

Downward and forward swinging of the inner end of the anchor links 130 soon pulls the upper end of the bend complex 125 outwardly, however. This increases the torque effect of the bend complex 125, compressing the body 28 of each band 120 rearwardly and creating uplift under the subject's thighs through the forward one-third of the band 120.

Employing the spring assembly 12 which has been described, excellent softness and uplift is provided even though only four primary spring band assemblies 32 are utilized. This reduces the cost of labor and materials for springing wedge seats. The outrigger spring band assemblies 33 are simple and inexpensive and provide all the support needed outboard of the primary assemblies 32.

Figure 6:
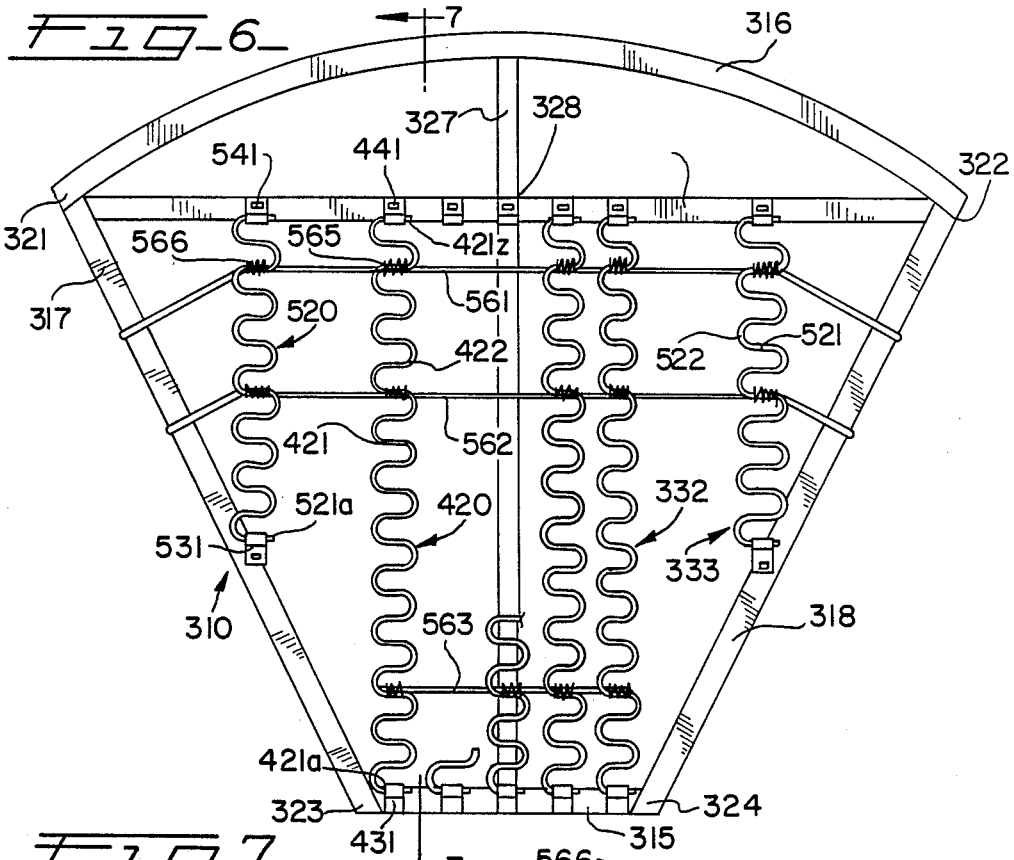
FIG. 6 is a plan view similar to FIG. 1 illustrating a second form of wedge seat assembly embodying features of the invention
Figure 7:
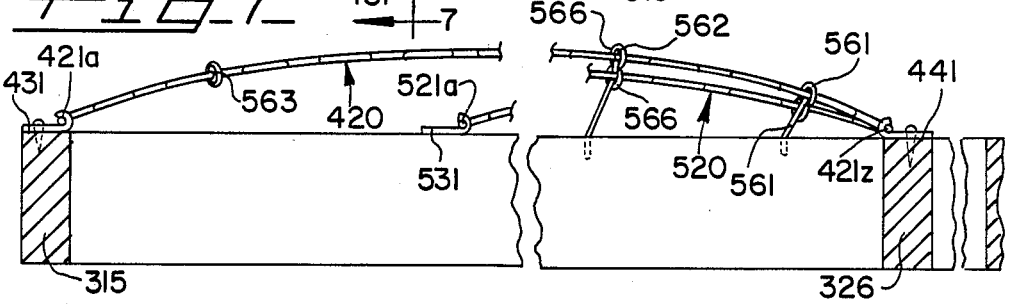
FIG. 7 is a sectional view taken along line 7—7 of FIG. 6.

Referring now to FIGS. 6 and 7, a wedge seat assembly embodying features of a second form of the present invention is illustrated generally at 310. The assembly 310 includes a wedge frame 311 in which is mounted a spring assembly 312, the latter once again adapted to be covered by upholstery fabric and to support a suitably shaped cushion (not shown).

The frame 311 is identical to the frame 11 hereinbefore discussed in relation to the first form of the present invention. As such, each of the components of the frame 311 is identical to a corresponding component of the frame 11 and is identified by a corresponding reference numeral, plus 300 digits.

The spring assembly 312 includes five primary spring band assemblies 332 mounted between the front rail 315 and the back spring rail 326. The spring assembly 312 also includes two secondary or "outrigger" spring band assemblies 333 mounted between the back spring rail 326 and each of the side rails 317 and 318.

Each spring band assembly 332 comprises a normally arced, "regular" loop, sinuous spring band 420. Each band 420 comprises a series of normally parallel linear wire segments 421 interconnected by a series of generally semi-circular wire segments 422, and is fabricated of eight gauge spring steel wire.

Each band 420 is mounted between the front rail 315 and the back spring rail 326 of the frame 311 by being stretched out (from a relaxed, generally circular configuration) and pivotally connected to corresponding rails at its forwardmost linear wire segment **421*a* and its rearwardmost linear wire segment 421z. The wire segment 421a is seated in a conventional EK clip 431 stapled to the top surface of the rail 315. The wire segment 421z. is seated in an EK clip 441 stapled to the top surface of the back spring rail 326**.

Each "outrigger" spring band assembly 333 comprises a normally arced, "regular" looped sinuous spring band 520. The band 520 comprises a series of normally parallel linear wire segments 521 interconnected by a series of generally semicircular wire segments 522. The band 520 is fabricated of lightweight, eleven gauge spring steel wire.

Each band 520 is mounted between a side rail 317 (or 318) and the back spring rail 326 of the frame 311 by being stretched out (from a relaxed, generally circular configuration) and pivotally connected to corresponding rails at its forwardmost linear segment **521*a* and at its rearwardmost linear wire segment 521z. The wire segment 521*a* is seated in a conventional EK clip 531 pivotally secured to the top surface of the corresponding side rails 17, or 18, just forward of its midpoint. The wire segment 521z is seated in an EK clip 541 stapled to the top surface of the rail 326**.

As previously described in relation to the first form of the invention, the clips 531 are pivotally secured to the side rails 317 and 318 by single attachment nails. The clips 431 are, accordingly, free to pivot into alignment with corresponding spring bands 333.

The spring assembly 312 also includes three tie wires 561, 562, and 563. Each wire 561, 562, and 563 comprises a single strand of eight gauge, paper-covered wire, and each is clamped to all four spring bands 420 by identical barrel clamps 565. The tie wires 561 and 562 are also clamped to the bands 520, as in the first form of the invention. Similarly, the tie wires 561 and 562 are stapled to side rails 317 and 318 at both ends. The tie wire 563 is clamped only to the bands 420. The tie wire construction and arrangement is identical to that illustrated in FIGS. 1 and 2, for example, except that five bands 420 are involved.

Figure 9:
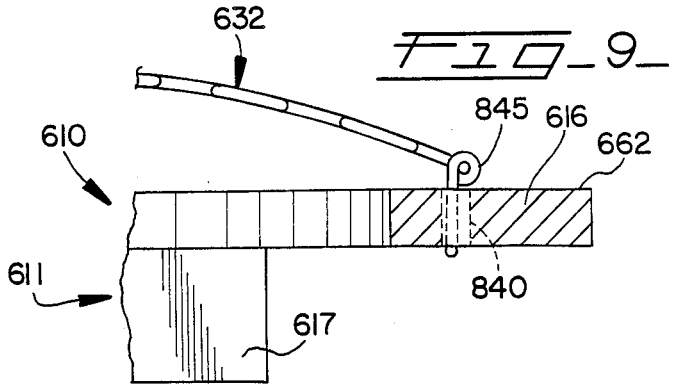
FIG. 9 is a sectional view taken along line 9—9 of FIG. 8.
Figure 8:
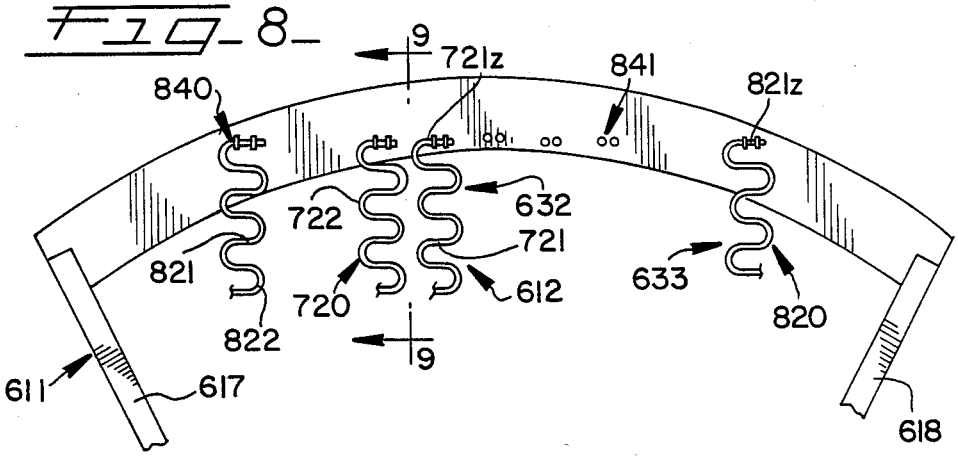
FIG. 8 is a plan view of the back rail and its spring band connections in a third form of wedge seat assembly embodying features of the invention.

Referring now to FIGS. 8 and 9, a portion of a wedge seat assembly embodying features of a third form of the present invention is illustrated generally at 610. The wedge seat assembly 610 is identical to the assembly 310 hereinbefore discussed, except for the construction of its frame 611 and of its spring assembly 612 frame connections.

The frame 611 incorporates a radically different back rail 616 than those previously discussed. The back rail 616 is a hardwood board which is seven eighths of an inch thick and three to four inches wide. It is glued and screwed at its opposite ends to the back ends of converging side rails 617 and 618. The rails 617 and 618 are identical to those discussed in relation to previous forms of the invention.

The spring assembly 612 comprises a plurality of primary spring band assemblies 632 and two secondary or "outrigger" spring band assemblies 633 identical to those discussed in relation to the second form of the invention. The primary spring band assemblies 632 each include a regular loop sinuous band 720 made up of linear wire segments 721 and semi-circular wire segments 722. The secondary spring band assemblies 633 each include a lighter weight sinuous band 820 made up of linear wire segments 821 and semi-circular wire segments 822.

In the wedge seat assembly 610, the rear end of each spring band 720 and 820, at its endmost linear wire segment 721z and 821z, respectively, is connected to the back rail 616 by anchor links 840 protruding upwardly through gang-bored pairs of holes 841 bored through the rail. The holes 841 are bored so that each pair of holes lies on a line parallel to the straight front rail (not shown) of the frame 611.

Each anchor 840 is passed upwardly through a pair of holes 841 so that its closed loop ends 845 protrude above the upper surface 852 of the rail 616. In this position the end linear segments (721*z* or 821*z*) are seated in the closed loop ends 845.

The wedge seat assembly employs a tie wire arrangement (not shown) identical to that previously discussed. The front rail and side rail connections of the bands 720 and 820, respectively, are identical to that discussed in relation to the second form of the invention.

Figure 10:
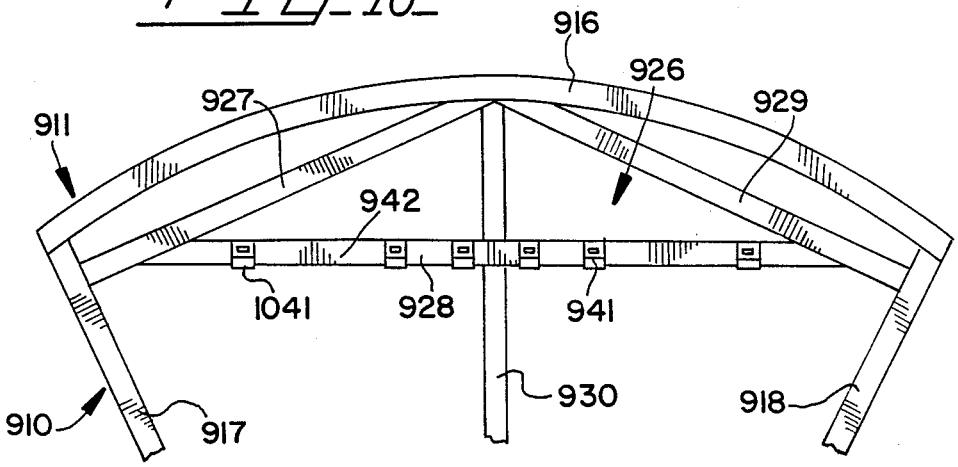
FIG. 10 is a plan view similar to FIG. 8 illustrating the back rail in a fourth form of wedge seat assembly embodying features of the invention.

Referring last to FIG. 10, a portion of a frame for a fourth form of wedge seat assembly 910 embodying features of the present invention is shown generally at 911. The wedge seat assembly 910 is identical to the wedge seat assembly 10 except for the frame 911 construction; more specifically, except for the construction of the back spring rail 926.

The rail 926 actually comprises three hardwood rail sections 927, 928 and 929. Two of these rail sections 927 and 929 are glued and screwed to the side rails 917, 918, and the back rail 916, on chords of the arc of rail 916, in the manner illustrated. They meet at the center of rail 916. A stretcher rail 930 is also provided.

The third rail section 928 is glued and screwed to the rail sections 927 and 929 at points approximately two-thirds of the distance between their inner and outer ends. The rail section 928 is disposed parallel to the front rail (not shown). It provides an anchor rail for the back of a spring assembly (not shown) in a manner corresponding to that described in relation to the first form of the invention. In this regard, EK clips 941 and 1041 are shown stapled to the top surface 942 of the rail section 928.

While the product embodiments described herein are at present considered to be preferred, it is understood that various modifications and improvements may be made therein, and it is intended to cover in the appended claims all such modifications and improvements as fall within the true spirit and scope of the invention.

I claim:

1. A furniture wedge seat, comprising:

(a) a frame and a spring assembly mounted in said frame;

(b) said frame including a relatively short front rail, relatively long back rail means, and two side rails rigidly joining said front rail to said back rail means and converging from said back rail means toward said front rail; said back rail means being at least three times as long as said front rail.

(c) said spring assembly including a plurality of primary spring elements extending parallel to each other; and (d) tie means extending transversely across said primary spring elements and interconnecting them.

2. The furniture wedge seat of claim 1 further characterized in that:

(a) said primary spring elements extend parallel to each other between said back rail means and said front rail.

3. The furniture wedge seat of claim 2 further characterized in that:

(a) said spring assembly further includes a secondary spring element extending parallel to said primary spring elements between said back rail means and each of said side rails;

(b) said tie means also extending transversely across said secondary spring elements and connecting them to said primary spring elements.

4. The furniture wedge seat of claim 3 further characterized in that:

(a) each of said primary spring elements comprises a sinuous spring band.

5. The furniture wedge seat of claim 4 further characterized in that:

(a) each of said secondary spring elements comprises a sinuous spring band.

6. The furniture wedge seat of claim 5 further characterized in that:

(a) said secondary spring element bands are fabricated from higher gauge, lighter wire than said primary sinuous spring bands.

7. The furniture wedge seat of claim 4 further characterized in that:

(a) said spring assembly includes a maximum of five primary spring bands.

8. The furniture wedge seat of claim 7 further characterized in that:

(a) said spring assembly includes four primary spring bands; and (b) torsion producing means on each of said primary spring bands (having torsion producing means associated therewith).

9. A furniture wedge seat, comprising:

(a) a frame, and a spring assembly mounted in said frame;

(b) said frame including a relatively short front rail, relatively long back rails means, and two side rails rigidly joining said front rail to said back rail means and converging from said back rail means towards said front rail;

(c) said back rail means including back spring rail means;

(d) said back spring rail means having back spring rail connector means mounted thereon;

(e) said spring assembly including a plurality of primary spring elements extending parallel to each other between said back spring rail connector means and said front rail;

(f) said spring assembly further including a secondary spring element extending parallel to said primary spring elements between said back spring rail connector means on each of said side rails; and (e) tie means extending transversely across said primary and secondary spring elements and interconnecting them.

10. The furniture wedge seat of claim 9 further characterized in that:

(a) said connector means includes a plurality of connector clips mounted on said spring rail in a line parallel with said front rail.

11. The furniture wedge seat of claim 10 further characterized in that:

(a) said back rail means includes a back rail and a back spring rail;

(b) said back rail having an arcuate configuration and said back spring rail being relatively straight and extending parallel to said front rail.

12. The furniture wedge seat of claim 10 further characterized in that:

(a) said back rail means and said back spring rail means both being embodied in an arcuate rail member;

(b) said arcuate rail member having a width of at least about three to four inches.

13. A furniture wedge seat, comprising:

(a) a frame, and a spring assembly mounted in said frame;

(b) said frame including a relatively short front rail, relatively long back rail means, and two side rails rigidly joining said front rail to said back rail means and converging from said back rail means towards said front rail;

(c) said spring assembly including a plurality of primary spring elements extending parallel to each other between said back rail means and said front rail;

(d) said spring assembly further including a secondary spring element extending parallel to said primary spring elements between said back rail means and each of said side rails;

(e) a connector clip mounted on top of each of said side rails and connecting a corresponding secondary spring element to each side rail;

(f) each of said connector clips being mounted for pivotal movement on a corresponding side rail whereby said clip automatically orientates itself in alignment with a corresponding secondary spring element; and (g) tie means extending transversely across said primary and secondary spring elements and interconnecting them.

14. The furniture wedge seat of claim 13 further characterized in that:

(a) each of said primary spring elements comprises a sinuous spring band.

15. The furniture wedge seat of claim 14 further characterized in that:

(a) each of said secondary spring elements comprises a sinuous spring band.

16. The furniture wedge seat of claim 15 further characterized in that:

(a) said secondary spring element bands are fabricated from higher gauge, lighter wire than said primary sinuous spring bands.

* * * * *

UNITED STATES PATENT AND TRADEMARK OFFICE

CERTIFICATE OF CORRECTION

PATENT NO. : 4,846,450

DATED : July 11, 1989

INVENTOR(S) : Lawton H. Crosby

It is certified that error appears in the above-identified patent and that said Letters Patent is hereby corrected as shown below:

In column 3, line 8, after the second occurrence of "rail" please delete ",".

In column 3, line 33, after "various" please delete ".".

In column 3, line 48, after "invention" please insert --;--.

In column 4, line 8, please delete "hard wood" and substitute therefor --hardwood--.

In column 6, line 42, after "262" please insert --,--.

In column 8, line 8, please delete "semicircular" and substitute therefor --semi-circular--.

In column 8, line 48, please delete "seven eighths" and substitute therefor --seven-eighths--.

In column 9, line 23, after "928" please insert --,--.

UNITED STATES PATENT AND TRADEMARK OFFICE

CERTIFICATE OF CORRECTION

PATENT NO. : 4,846,450

DATED : July 11, 1989

INVENTOR(S) : Lawton H. Crosby

It is certified that error appears in the above-identified patent and that said Letters Patent is hereby corrected as shown below:

In claim 1, lines 8 and 9, please delete "said back rail means being at least three times as long as said front rail.", and insert a new subparagraph beginning on line 9 --(c) said back rail means being at least three times as long as said front rail;--.

In claim 1, line 10, please delete "(c)" and substitute therefor --(d)--.

In claim 1, line 13, please delete "(d)" and substitute therefor --(e)--.

Signed and Sealed this

First Day of September, 1992

*Attest:*

DOUGLAS B. COMER

*Attesting Officer*

*Acting Commissioner of Patents and Trademarks*